United States Patent [19]

Kawai et al.

[11] Patent Number: 4,492,199

[45] Date of Patent: Jan. 8, 1985

[54] AIR-FUEL RATIO COMPENSATING APPARATUS FOR INTERNAL COMBUSTION ENGINE

[75] Inventors: Yukio Kawai, Toyota; Toshihisa Ogawa, Aichi; Seietsu Yoshida, Kariya, all of Japan

[73] Assignee: Toyota Jidosha Kabushiki Kaisha, Toyota, Japan

[21] Appl. No.: 417,853

[22] Filed: Sep. 14, 1982

[51] Int. Cl.[3] ..... F02M 7/24

[52] U.S. Cl. ..... 123/440; 123/438

[58] Field of Search ..... 123/440, 438

[56] References Cited

U.S. PATENT DOCUMENTS

| | | | |
|---|---|---|---|
| 4,169,439 | 10/1979 | Tsiang et al. | 123/440 |
| 4,197,822 | 4/1980 | Tsiang | 123/440 |
| 4,306,523 | 12/1981 | Takeda | 123/440 |

*Primary Examiner*—Andrew M. Dolinar

*Attorney, Agent, or Firm*—Finnegan, Henderson, Farabow, Garrett & Dunner

[57] ABSTRACT

An air-fuel ratio compensating apparatus for the carburetor of an internal combustion engine has first and second valves having equal control (input) current-opening characteristics and provided in main and slow system air bleed paths respectively to control sectional area of flow in the main and slow system air bleed paths in relation to the output of an air-fuel ratio sensor, electronic control circuit which sends the control current to the first and second valves in such a way that the opening of the second valve is always larger than that of the first valve. Thus, flow of the main system air bleed is restrained during the initial part of the acceleration period so as to reduce the amount of noxious component in the exhaust gas.

4 Claims, 4 Drawing Figures

AIR-FUEL RATIO COMPENSATING APPARATUS FOR INTERNAL COMBUSTION ENGINE

BACKGROUND OF THE INVENTION

1. Field of the Invention

This invention relates to an air-fuel ratio compensating apparatus for an internal combustion engine which controls the amount of air bleed in a carburetor in relation to the output of an air-fuel ratio sensor.

2. Description of Prior Art

In air-fuel ratio compensating apparatus first and second electromagnetic valves are provided respectively in the air bleed paths of the main and slow fuel supply systems of the carburetor, and the openings of the first and second electromagnetic valves are controlled in relation to the output of the air-fuel ratio sensor. In prior art-fuel ratio compensating apparatus, control current-opening characteristics of the first and second electromagnetic valves are equal to each other and the same control current is sent to the first and second electromagnetic valves from an electronic circuit section. It is preferable that during acceleration of an automobile, fuel is supplied early only from the slow system, and thereafter the fuel supply of the slow system is gradually reduced while fuel supply from the main system is increased, and finally fuel is supplied only from the main system. In such prior air-fuel ratio compensating apparatus, however, the amount of air bleed in the main system is increased during the acceleration period, so the mixture becomes extremely lean and the amount of noxious component in the exhaust is disadvantageously increased. It was previously disclosed that the control current-opening characteristics in the first and second electromagnetic valves could be made different from each other. However in such case, two types of electromagnetic valves are needed which is disadvantageous from a production and assembly standpoint.

SUMMARY OF THE INVENTION

An object of the present invention is to provide an air-fuel ratio compensating apparatus for the carburetor of an internal combustion engine so that the engine is smoothly shifted between the main and slow systems and the apparatus advantageously produced and assembled.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

According to the present invention as embodied and broadly described herein, in order to achieve these objects, in air-fuel ratio compensating apparatus for the carburetor of an internal combustion engine is provided which comprises a first electromagnetically controlled valve for controlling the amount of air bled into the main fuel supply system of the carburetor and a second electromagnetically controlled valve for controlling the amount of air bled into the slow fuel supply system of the carburetor, said first and second valves having equal opening characteristics in response to the same input current, an electronic circuit responsive to the air-fuel ratio condition of the engine for providing input currents to said first and second valves for controlling the operation thereof, said electronic circuit having first and second output drive means connected respectively to said first and second valves for providing an input current to said second valve larger than the input current applied to said first valve such that the second valve is opening a greater amount than the first valve in response to a deviation of the air-fuel ratio condition of the engine.

Thus, flow of air bleed in the main system during the acceleration period is restrained and the amount of noxious component in exhaust is reduced.

Preferably, this air-fuel ratio compensating apparatus is provided with a integrating network for integrating the output of the air-fuel ratio sensor, a drive section for the main system driving the first valve in relation to the output of this integrating network and a drive section for the slow system driving the second valve in relation to the output of the integrating network, the drive sections for the main and slow systems being designed such that the output current of the drive section for the slow system becomes larger than that for the main system with respect to the same output voltage of the integrating network.

The drive sections for the slow and main systems preferably determine the output current from the comparison between the output of the integrating network and a triangular wave output of a triangular wave generating circuit.

It is also preferred that in the air-fuel ratio compensating apparatus the drive sections for the main and slow systems are provided with power amplifiers for driving the first and second valves, feedback amplifiers for generating voltages related to operating time of said power amplifiers, integrators for integrating the difference between the output of the integrating network and that of the feedback amplifiers and comparators for comparing the output of the integrators with the triangular wave of the triangular wave generating circuit to control the conduction of the power amplifiers in relation to the comparative result, and the input resistances of these feedback amplifiers are selected so that the average value of the input voltage of the feedback amplifier in the drive section for the slow system becomes larger than that of the input voltage of the feedback amplifier in the drive section for the main system.

The above-mentioned and other objects and features of the invention will become apparent from the following detailed description taken in conjunction with the drawings which indicate an embodiment of the invention.

DETAILED DESCRIPTION OF THE PREFERRED EMBODIMENT

Figure 1:
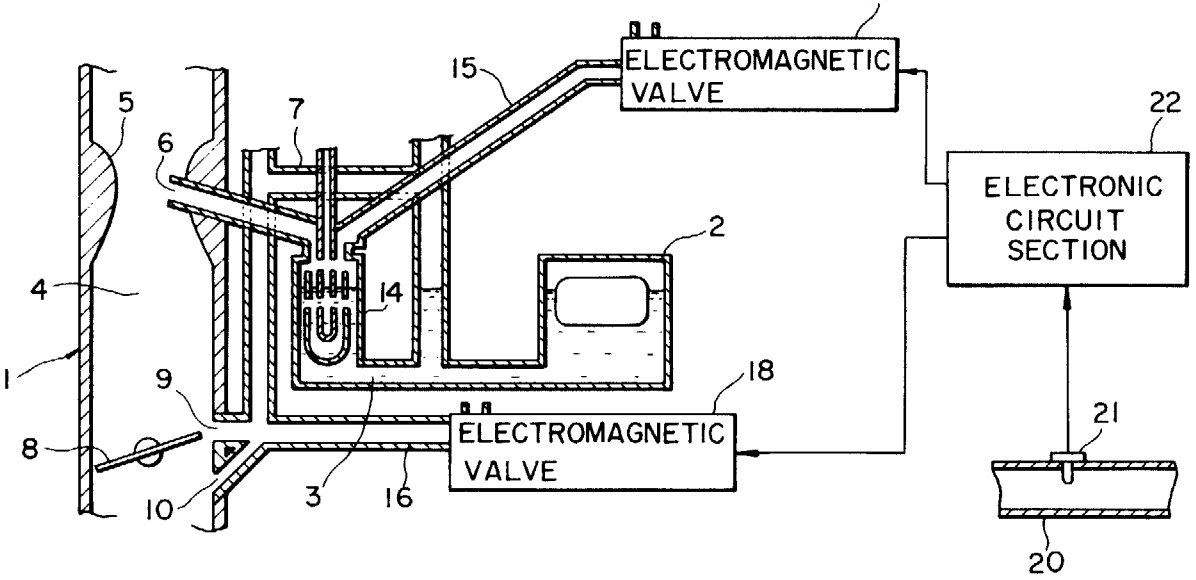
FIG. 1 is a schematic view of the whole embodiment of an air-fuel ratio compensating apparatus constructed according to the present invention.

With reference to FIG. 1, the preferred embodiment of an air-fuel ratio compensating apparatus constructed according to this invention is schematically illustrated.

A float chamber 2 in a carburetor 1 is connected through a main fuel path 3 to a main nozzle 6 which is provided in Venturi tube 5 in intake path 4. Chamber 2 is also connected through a slow fuel path 7 to slow port 9 and idle port 10 provided near a throttle valve 8 in the intake path 4. An emulsion section 14 is provided in the main path 3, and connected to path 3 is a main air bleed path 15. Also, a slow air bleed path 16 is connected to the slow fuel path. Electromagnetic valves 17, 18 are provided respectively in main and slow air bleed paths 15, 16. The electromagnetic valves 17, 18 are constructed in a well-known manner so as to move their valve bodies and vary the openings in their respective air bleed paths in relation to control current. A conventional air-fuel ratio sensor 21 for detecting oxygen concentration in exhaust gas is provided in an exhaust pipe 20 and the output of the air-fuel ratio sensor 21 is sent to an electronic circuit section 22.

Figure 2:
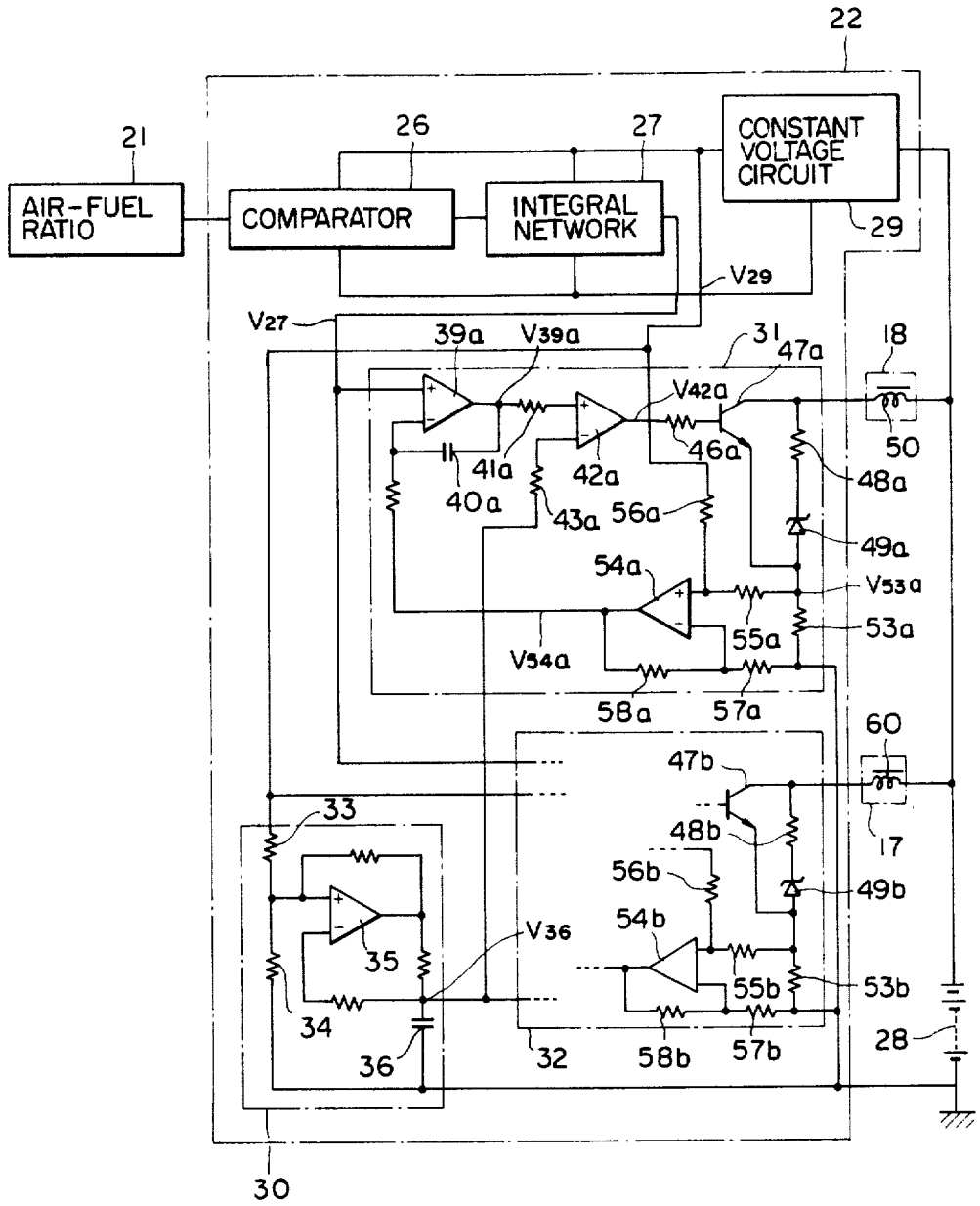
FIG. 2 is a detail view showing the electronic circuit section in FIG. 1.
Figure 3:
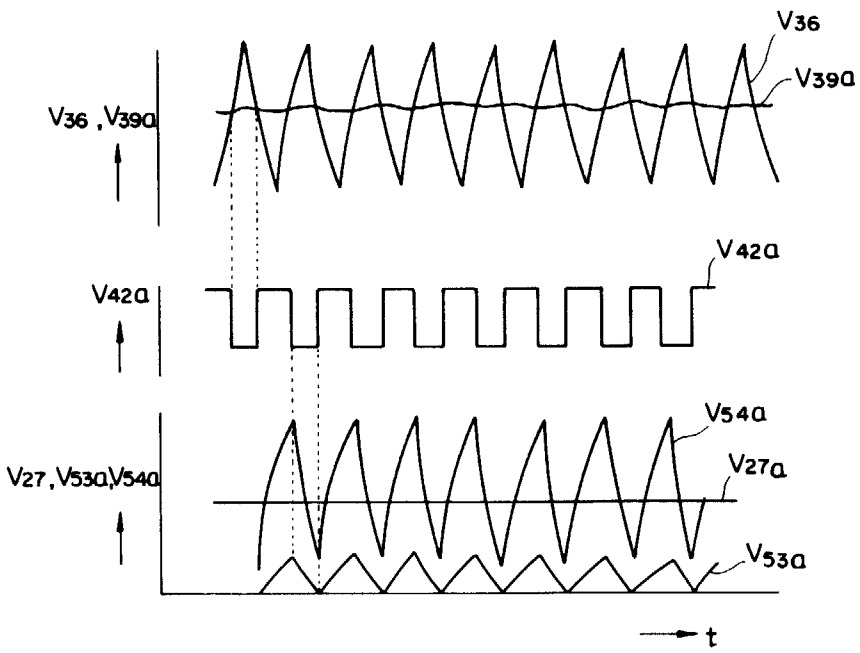
FIG. 3 is a view showing various voltage waveforms at selected locations in FIG. 2.

FIG. 2 shows the detail of the electronic circuit section 22 and FIG. 3 shows voltage waveforms at selected locations in the electronic circuit section 22. Further, abscissa t in FIG. 3 indicates time. The output of the air-fuel ratio sensor 21 is maintained at "1" when the mixture is lean and at "0" when the mixture is too rich (hereinafter, high level voltage is defined as "1" and low level voltage as "0", respectively). The output of the air-fuel ratio sensor 21 is sent to a comparator 26 to be shaped and therefrom sent to an integral network 27. While the output of the air-fuel ratio sensor 21 is maintained at "1", the output of the integral network 27 is decreased and while the output of the air-fuel ratio sensor 21 is maintained at "0", the output of the integral network 27 is increased. Voltage across a battery 28 for a DC power source is adjusted to constant voltage $V_{29}$ by a constant voltage circuit 29 and then sent to the comparator 26, integral network 27, triangular wave generating circuit 30 and drive sections 31, 32 at the slow and main sides.

In the triangular wave generating circuit 30, a non-inverting terminal of an operational amplifier 35 is maintained at positive voltage by the voltage-divider formed of resistances 33, 34. When voltage of the non-inverting terminal is higher than that of inverting terminal in the operational amplifier 35, the output of the operational amplifier 35 is maintaned at "1" and terminal voltage $V_{36}$ of a capacitor 36 increases. When the terminal voltage $V_{36}$ exceeds a predetermined value, the voltage of inverting terminal of the operational amplifier 35 becomes higher than that of the non-inverting terminal, so that the output of the operational amplifier 35 is inverted from "1" to "0" and thereafter the terminal voltage $V_{36}$ across the capacitor 36 decays. Thus, triangular waves as shown in FIG. 3 are formed.

The first and second drive sections 31, 32 are of the same construction except for the resistance value at the last stage, and only the first drive section 31 will be described. The output of the integral network 27 is sent to an integrator consisting of an operational amplifier 39*a* and a capacitor 40*a*, and the output $V_{39a}$ of the operational amplifier 39*a* is sent to a non-inverting terminal of a comparator 42*a* through resistance 41*a*. The output $V_{36}$ of the triangular wave generating circuit 30 is sent to the inverting terminal of the comparator 42*a* through a resistance 43*a*. Thus, when $V_{39a} > V_{36}$, the output of the comparator 42*a* is maintained and "1" and when $V_{39a} < V_{36}$, the output of the comparator 42*a* maintained at "0". A pulse output is formed as shown by $V_{42a}$ in FIG. 3. The higher the output voltage of the integral network 27 is, i.e. the more the mixture deviates to the rich side, the more the pulse width of the output $V_{42a}$ of the comparator 42*a* increases.

The output of the comparator 42*a* is sent to the base of a power amplifier 47*a* through a resistance 46*a*. The power amplifier 47*a* is connected in series to a solenoid 50 in the slow side electromagnetic valve 18, and a protective series circuit consisting of a resistance 48*a* and Zener diode 49*a* is connected in parallel to the power amplifier 47*a*. Thus, the more the mixture deviates to the rich side, the longer the conduction time of the power amplifier 47*a* and the wider the opening of the slow side electromagnetic valve 18 becomes. Consequently, the amount of air bleed is increased to reduce fuel supply so that the mixture shifts to the lean side.

The emitter of the power amplifier 47*a* is grounded through a resistance 53*a*. The non-inverting terminal in an operational amplifier 54*a* is connected to the emitter of the power amplifier 47*a* through a resistance 55*a* and to the constant voltage circuit 29 through a resistance 56*a*. The inverting terminal is grounded through a resistance 57*a* and connected to the output terminal of amplifier 54*a* through a negative feedback resistance 58*a*. As shown in FIG. 3, the power amplifier 47*a* output voltage $V_{53a}$ measured across the resistance 53*a* is amplified by the operational amplifier 54*a* so that voltage $V_{54a}$ after the amplification is sent to the inverting terminal of the operational amplifier 39. Since the integrator comprising the operational amplifier 39 amplifies the difference between $V_{27}$ and $V_{54a}$, the shorter the conduction time of the power amplifier 47*a*, the larger the difference between $V_{27}$ and $V_{54a}$ and the more the output $V_{39a}$ of the integrator increases. As a result, the conduction time of the power amplifier 47*a* is increased. Although only the first drive section 31 has been described, in the operation of the main side drive section 32, control current is sent to a solenoid 60 in the main side electromagnetic valve 17.

Considering the output voltage $V_{54a}$ of the operational amplifier 54*a*, average value $\overline{V}_{54a}$ of the output voltage $V_{54a}$ is represented by the following formula.

$$\overline{V}_{54a} = \alpha \cdot \left( \frac{V_{29} - \overline{V}_{53a}}{R_{55a} + R_{56a}} \cdot R_{55a} + \overline{V}_{53a} \right)$$

$$\alpha = \frac{R_{57a} + R_{58a}}{R_{57a}}$$

where $\overline{V}_{53a}$ is average value of $V_{53a}$, $\alpha$ is amplification rate of the operational amplifier 54*a* and $R_{55a}$, $R_{56a}$, $R_{57a}$ and $R_{58a}$ are respectively values of resistances 55*a*, 56*a*, 57*a* and 58*a*. Further, if $V_{29} = \overline{V}_{54a}$ is selected, $\overline{V}_{53a}$ can be represented by the following formula:

$$\overline{V}_{53a} = \left( 1 + \frac{R_{55a}}{R_{56a}} \right) \cdot \frac{V_{29}}{\alpha} - \frac{R_{55a}}{R_{56a}} \cdot V_{29}$$

Figure 4:
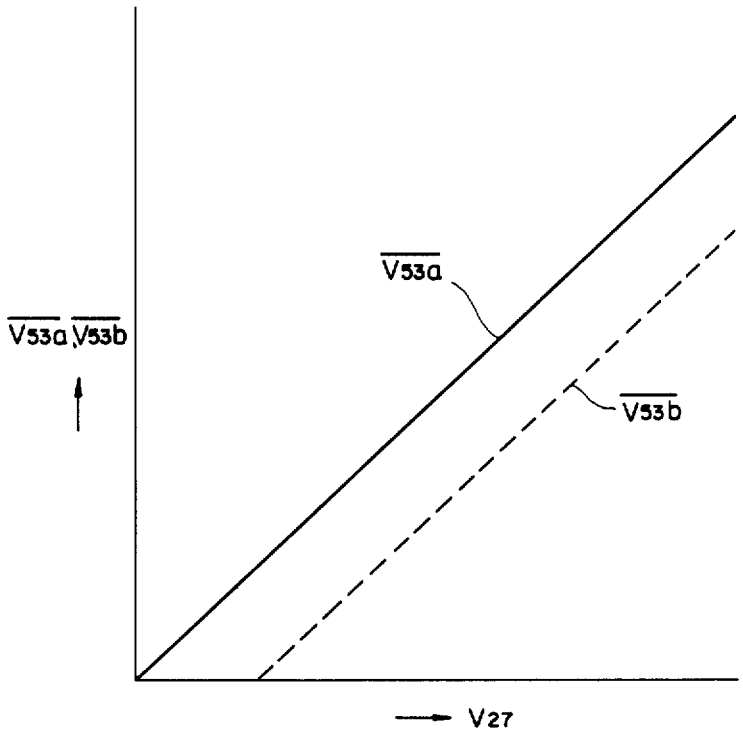
FIG. 4 is a graph showing the relationship between the output of the integral network in FIG. 2 and the output current of the drives of the slow and main sides.

Thus, $\overline{V}_{53a}$ can be altered by changing only values of $R_{55a}$, $R_{56a}$. According to the present invention, the values of resistances 55*a*, 56*a*, 55*b* and 56*b* are selected so as to provide $\overline{V}_{53a} > \overline{V}_{53b}$ for obtaining $V_{27} - \overline{V}_{53a}$ (solid line) and $V_{27} - V_{53b}$ (broken line) characteristics as shown in FIG. 4.

Consequently, even in acceleration, the amount of air bleed in the main system is properly restrained, and the fuel supply shifts smoothly from the slow system to the main one.

Thus, according to the present invention, the output current of the slow and main side drive sections 31, 32 is selected to make the slow side larger than the main side one so that the electromagnetic valves 17, 18 having equal control current-opening characteristics may be used for the main and slow systems and the shift between the slow system and the main one may be carried out smoothly.

Further in this embodiment, while the control current of drive sections 32, 31 is sent to solenoids 60, 50 of the electromagnetic valves 17, 18, a valve having the opening adjusted by a servo motor having linear characteristics may be provided instead of the electromagnetic valves 17, 18 so as to send the control current to this servo motor.

What is claimed is:

1. An air-fuel ratio compensating apparatus for the carburetor of an internal combustion engine comprising a first electromagnetically controlled valve for controlling the amount of air bled into the main fuel supply system of the carburetor and a second electromagnetically controlled valve for controlling the amount of air bled into the slow fuel supply system of the carburetor, said first and second valves having equal opening characteristics in response to the same input current, an electronic circuit responsive to the air-fuel ratio condition of the engine for providing input currents to said first and second valves for controlling the operation thereof, said electronic circuit having first and second output drive means connected respectively to said first and second valves for providing an input current to said second valve which is always larger than the input current applied to said first valve such that the second valve is opened a greater amount than the first valve in response to a deviation of the air-fuel ratio condition of the engine.

2. An air-fuel ratio compensating apparatus as defined in claim 1, further comprising an air-fuel ratio sensor, and wherein said electronic circuit includes an integrating circuit for integrating the output of the air-fuel ratio sensor, said first and second output drive means being responsive to the output of said integrating circuit.

3. An air-fuel ratio compensating apparatus as defined in claim 2, wherein said electronic circuit further includes a triangular wave generating circuit and first and second comparators, said comparators connected between said integrating circuit and said first and second output drive means, respectively, and responsive to the output of said integrating circuit and the triangular wave output of said triangular wave generating circuit to provide a pulse output to said first and second output drive means.

4. An air-fuel ratio compensating apparatus as defined in claim 3, wherein said first and second output drive means includes first and second power amplifiers having pulse outputs, respectively, for driving said first and second valves, and said electronic circuit further includes first and second feedback amplifiers responsive to the pulse output, respectively, of said first and second power amplifiers, first and second integrators for integrating the difference between the output of said integrating circuit and said respective first and second feedback amplifiers, said comparators comparing the output of their respective integrators with the triangular wave output of said triangular wave generating circuit to control the conduction of their respective power amplifiers, each of said feedback amplifiers, having a separate input resistance whose value is selected to provide an average value of input voltage of the feedback amplifier responsive to the second power amplifier larger than that of the feedback amplifier responsive to the first power amplifier.

* * * * *